US007209023B2

(12) United States Patent
Klocinski et al.

(10) Patent No.: US 7,209,023 B2
(45) Date of Patent: Apr. 24, 2007

(54) IGNITION COIL WITH SEPARATING WALL

(75) Inventors: James John Klocinski, Saline, MI (US); Robert Charles Bauman, Brighton, MI (US); Rick S. Burchett, Ypsilanti, MI (US); William Douglas Walker, Saline, MI (US)

(73) Assignee: Ford Motor Company, Dearborn, MI (US)

( * ) Notice: Subject to any disclaimer, the term of this patent is extended or adjusted under 35 U.S.C. 154(b) by 86 days.

(21) Appl. No.: 10/807,663

(22) Filed: Mar. 24, 2004

(65) Prior Publication Data

US 2005/0212635 A1 Sep. 29, 2005

(51) Int. Cl.
*H01F 27/02* (2006.01)

(52) U.S. Cl. ..... 336/90

(58) Field of Classification Search ..... 336/65, 336/90–96, 198; 123/634–635
See application file for complete search history.

(56) References Cited

U.S. PATENT DOCUMENTS 3,821,677 A 6/1974 Boaz
4,248,201 A 2/1981 Tsutsui et al.
4,658,799 A 4/1987 Kusaka et al.
4,843,362 A * 6/1989 Heritier-Best ..... 336/61
4,926,152 A 5/1990 Ito et al.
4,990,881 A 2/1991 Ooyabu
5,157,368 A 10/1992 Okano et al.
5,349,320 A * 9/1994 Suzuki et al. ..... 336/92
5,357,233 A 10/1994 Wada
5,497,756 A 3/1996 Matthiesen et al.
5,685,065 A * 11/1997 Suzuki et al. ..... 29/606
5,764,124 A * 6/1998 Nakamichi et al. ..... 336/92
6,427,673 B2 8/2002 Morganti et al.

* cited by examiner

*Primary Examiner*—Tuyen T Nguyen
(74) *Attorney, Agent, or Firm*—Mark Sparschu; MacMillan Sobanski & Todd

(57) ABSTRACT

An ignition coil for an internal combustion engine minimizes the propagation of cracks in the encapsulate material surrounding the components of the ignition coil and provides a supplemental dielectric barrier. In one embodiment, the ignition coil comprises a housing, an outer core, an inner coil, and a coil assembly. The housing includes a bottom wall connected to an outer wall extending around the periphery of the housing. The outer core is positioned inside the outer wall, while the inner core is positioned inside the outer core. The coil assembly includes a primary winding and a secondary winding concentrically positioned relative to each other. The coil assembly is mounted to the inner core and positioned inside the outer core. The housing further includes an inner wall extending along the inner periphery of the outer core and positioned between the outer core and the coil assembly to prevent propagation of cracks.

16 Claims, 2 Drawing Sheets

IGNITION COIL WITH SEPARATING WALL

FIELD OF THE INVENTION

The present invention relates generally to ignitions coils, and more particularly relates to limiting the propagation of cracks in the encapsulate material of the ignition coil.

BACKGROUND OF THE INVENTION

Ignition coils typically contain a variety of internal components constructed of a variety of different materials. In general, ignition coils typically contain a core assembly constructed of steel lamination stacks upon which the primary and secondary coils of a coil assembly are mounted. The primary and secondary coils typically include a plastic bobbin which is wound with copper wire. The core assembly includes an outer steel lamination stack that engages an inner lamination stack and extends around the coil assembly. A plastic housing is provided to enclose these aforementioned components. An encapsulate such as a thermosetting resin is poured into the housing to fill all gaps that surround the entire assembly.

The lamination stacks forming the core are typically made of silicon steel, and are sufficiently sized to carry the magnetic flux generated by the ignition coil. The other components of the ignition coil, namely the encapsulate and the coil assembly, are made of plastics and resins which have a coefficient of thermal expansion (CTE) 2 to 5 times higher than the steel laminations, while the copper has a CTE about 1.5 times higher than steel. Unfortunately, this mismatch in CTE's can cause cracking in the encapsulate resin surrounding the steel lamination stacks, which can propagate into the secondary windings. With such cracks, the ignition coil can experience internal dielectric failure. Since the secondary windings can carry charges up to 35 K volts, and the lamination stacks have voltage near ground potential, there remains a potential for dielectric breakdown from the secondary windings to the steel laminations.

Accordingly, there exists a need to provide an ignition coil which minimizes the propagation of cracks in the encapsulating resin, thereby reducing the potential for internal dielectric failure.

BRIEF SUMMARY OF THE INVENTION

The present invention provides an ignition coil for an internal combustion engine that minimizes the propagation of cracks in the encapsulate material surrounding the components of the ignition coil. In one embodiment, the ignition coil comprises a housing, an outer core, an inner coil, and a coil assembly. The housing includes a bottom wall connected to an outer wall extending around the periphery of the housing. The outer core is positioned inside the outer wall, while the inner core is positioned inside the outer core. The coil assembly includes a primary winding and a secondary winding concentrically positioned relative to each other. The coil assembly is mounted to the inner core and positioned inside the outer core. The housing further includes an inner wall extending along the inner periphery of the outer core and positioned between the outer core and the coil assembly. In this way, the inner wall can prevent propagation of cracks into the encapsulate material surrounding the coil assembly, thereby preventing dielectric breakdown. The inner wall also provides a dielectric barrier between the secondary coil and the laminations.

According to more detailed aspects, the inner wall separates the outer core from direct contact with encapsulate in the vicinity of the coil assembly. The inner wall defines an inner compartment, while the inner and outer walls define an outer compartment therebetween. The inner chamber is filled with encapsulate, and the outer chamber may also be filled with encapsulate. However, the outer compartment may be filled with a substance different than the encapsulate. For example, the outer compartment may be filled with air, or may be filled with a substance that is more ductile and pliable, such as an elastomeric material, that can better absorb the expansion and contraction of the assembly and shield the outer core from the rest of the encapsulate material to prevent propagation of cracks.

According to still more detailed aspects, the inner wall preferably extends between the inner core and the outer core to form an air gap therebetween. The inner wall may extend between one or both ends of the inner core and the outer core to form air gap(s) therebetween. When the inner wall forms an air gap, the inner wall may include a reduced thickness portions adjacent the end of the inner core. One end of the inner core may included a permanent magnet attached thereto which extends through an aperture formed in the inner wall to engage the outer core. The inner wall may also include a permanent magnet integrally formed therein and positioned adjacent the first end of the inner core.

According to even more detailed aspects, the inner wall preferably extends upwardly to a position at or above an upper surface of the outer core. The inner wall may also extend upwardly to a position at or above the upper surface of the coil assembly. Alternatively, the inner wall may extend upwardly to a position aligned with an upper end of the outer wall to completely separate the inner and outer compartments of the housing. Preferably, the inner wall is integrally formed with the housing and constructed of a plastic material. The inner wall is preferably not integrally formed with the outer core.

In another embodiment of the present invention, a method is provided for constructing the ignition coil for an internal combustion engine. The method generally includes the steps of providing a housing having an outer wall and an inner wall, the walls defining an inner compartment and an outer compartment, providing an inner core, an outer core and a coil assembly, the coil assembly being mounted to the inner core, positioning the outer core within the outer compartment, positioning the inner core and coil assembly within the inner compartment, and filling the inner compartment with an encapsulate without filling the outer compartment at the same time.

The method may further comprise the step of filling the outer compartment with a second encapsulate that is different from the first encapsulate. The second encapsulate may comprise a substance that is more ductile and pliable, such as an elastomeric material, that can better absorb the expansion and contraction of the assembly and shield the outer core from the rest of the encapsulate material to prevent propagation of cracks. The inner wall is preferably integrally formed with the housing and not integrally formed with the outer core. The inner wall may extend between the first end of the inner core and the outer core to form an air gap therebetween. The inner wall preferably extends upwardly to a position at or above an upper surface of the outer core.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
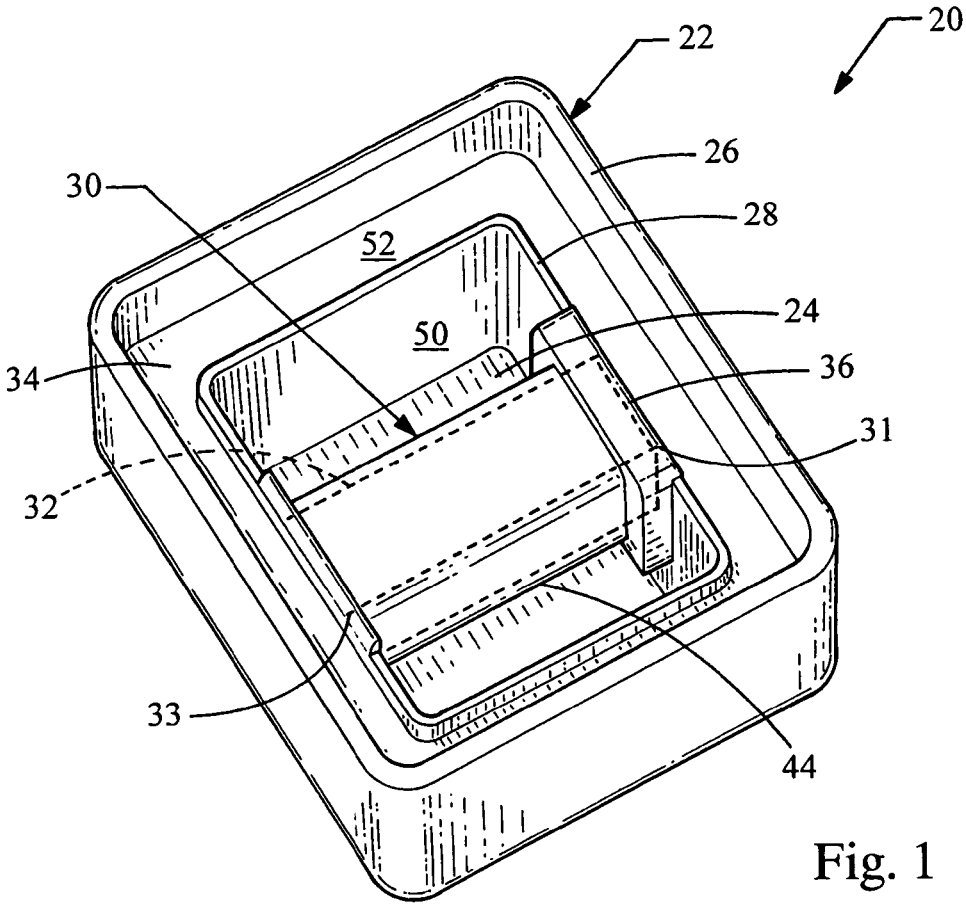
FIG. 1 is a perspective view of an ignition coil, with the windings removed, constructed in accordance with the teachings of the present invention.
Figure 2:
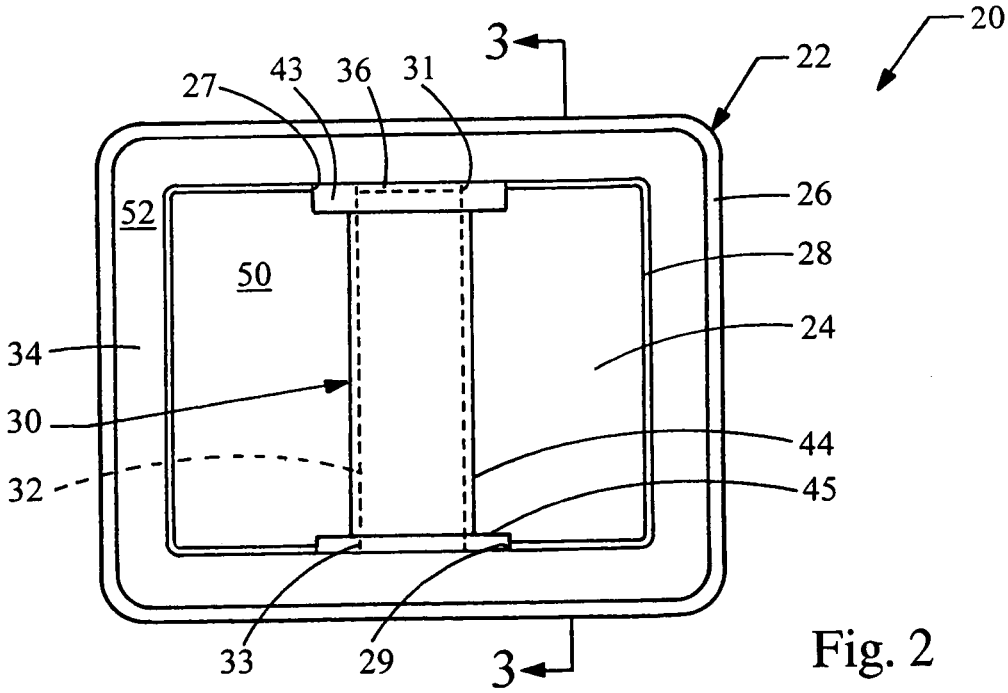
FIG. 2 is a top view of the ignition coil of FIG. 1.
Figure 3:
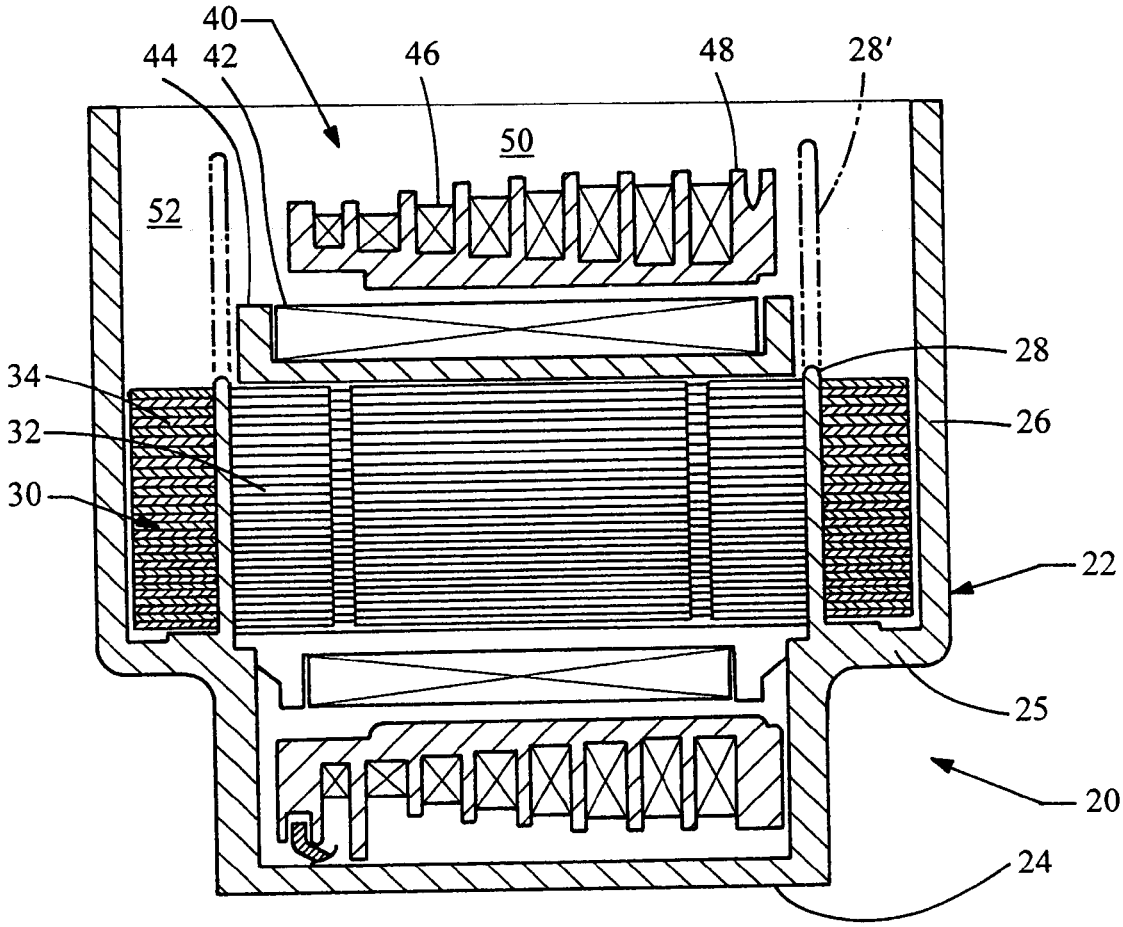
FIG. 3 is a cross-sectional view taken about the line 3—3 in FIG. 2.

Turning now to the figures, FIGS. 1, 2 and 3 depict perspective, top and cross-sectional views of an ignition coil 20 constructed in accordance with the teachings of the present invention. The ignition coil 20 generally includes a housing member 22 which encloses a core assembly 30 and a coil assembly 40 (FIG. 3). The housing 22 includes a bottom wall 24 and an outer wall 26 extending upwardly from the bottom wall 24. The outer wall 26 extends around the periphery of the ignition coil 20.

The housing 22 also includes an inner wall 28 which is spaced radially inwardly from the outer wall 26. As best seen in FIGS. 1 and 2, the inner wall 28 generally defines an inner compartment 50. An outer compartment 52 is defined between the inner wall 28 and the outer 26. As such, the outer compartment 52 is annular or ring-shaped. As will be discussed in more detail below, the inner wall 28 is employed in order to prevent propagation of cracks in an encapsulate filling the housing 22, thereby preventing dielectric breakdown of the ignition coil 20. The inner wall 28 also provides a dielectric barrier between the secondary winding 46 and the outer lamination 34 and allows different encapsulate materials to be used for the windings and the laminations.

The core assembly 30 generally includes an inner core 32 and an outer core 34. The inner and outer cores 32, 34 combine to form a FIG. 8 or B-shape as best seen in FIG. 2. The inner core 32 generally comprises an I-shaped steel lamination stack which can be seen in the cross-sectional view of FIG. 3. The outer core 34 generally comprises an O-shaped steel lamination stack. As is known in the art, the steel lamination stacks are preferably constructed of a silicon steel, sheets of which are stamped and the cutouts stacked to form the steel laminations. Although the term "steel lamination stack" or "lamination stack" is used herein, it will be recognized that any metal, preferably with a high magnetic permeability, may be employed in the core assembly 30, which may also be constructed in solid or other non-laminate forms.

In FIGS. 1 and 2, the inner core 32 has been shown hidden behind a primary bobbin 44. The primary bobbin 44 generally includes a first flange 43 and a second flange 45 on opposing ends thereof. As best seen in FIGS. 1 and 2, the inner core 32 and the primary bobbin 44 engage the outer core 34 at opposing ends of the I-shape. Thus, the inner wall 28 includes a first aperture 27 which is sized and positioned to receive the first flange 43 and the first end 31 of the inner core 32. The inner wall 28 also includes a second aperture 29 sized and positioned to receive the second flange 45 and the second end 33 of the inner core 32.

It can also be seen in FIG. 2 that the core assembly 30 includes an air gap 36 formed at the first end 30 of the inner core 32. As is known in the art, the air gap 36 serves a storage function for the energy generated by the primary winding 42 which is transferred to the secondary winding 46 for delivering a high voltage to the spark plug for initiating the combustion process. It will also be recognized that the air gap 36 may be formed by a permanent magnet, or may also be any other material of low magnetic permeability, preferably plastic or epoxy.

As best seen in FIG. 3, the coil assembly 40 generally includes a primary winding 42 and a secondary winding 46. In particular, a primary bobbin 44 has a primary winding form thereon, and serves as a dielectric barrier between the core assembly 30 and the inner core 30 and the windings 42. The secondary winding 46 is wound on a secondary insulative bobbin 48 and is concentrically mounted relative to the primary winding 42. During assembly, the primary and secondary coils 42, 46 are wound on their respective bobbins 44, 48 and mounted to the I-shaped lamination stack forming the inner core 32. This assembly is then slid inside the outer core 34, all of which is placed within the housing 20. It will be recognized that the outer core lamination 34 can be positioned inside the housing 20 before or after the inner core lamination 32 and the coil assembly 40 is fitted therein.

As best seen in FIG. 3, the inner wall 28 extends upwardly from the bottom wall 24, and more particularly from a seat portion 25 on which the outer core 34 rests. As shown, the inner wall 28 extends up to a point at or above the core assembly 30, and in particular the outer core 34. The inner wall 28 may also extend upwardly to a point at or above the coil assembly 40, and in particular the second winding 46, as is shown in the phantom lines of FIG. 3 and denoted by reference numeral 28'. In another embodiment, the inner wall 28 extends all the way up to a point about equal to the upper end of the outer wall 26, to thereby completely separate the inner compartment from 50 from the outer compartment 52.

In the typical manufacturing process, once the core assembly 30 and coil assembly 40 are placed within the housing 20, the entire housing 20 would be filled with an encapsulate material. The encapsulated material is preferably a thermosetting resin such as an epoxy, although it will be recognized by those skilled in the art that the encapsulate can comprise any suitable material.

According to the present invention, when the inner compartment 50 and outer compartment 52 are filled with the encapsulate (not shown) the inner wall 28 serves as a barrier between the outer core 34 and the coil assembly 40. That is, due to the mismatch between CTE's of the outer core 34 and the encapsulate material surrounding the same, a crack may form in the encapsulate that is proximate the outer core 34. However, any such cracks would be prevented from propagating to the encapsulate surrounding the coil assembly 40 by way of the inner wall 28 which provides a discontinuity therebetween.

It will also be seen that the manufacturing method may also include the step of filling the inner chamber 50 without filling the outer chamber 52 at the same time. In this way, the outer chamber 52 may simply be left filled with air, or alternatively may be filled with a second encapsulate material that is different than the first encapsulate material in the inner compartment 50. For example, the second encapsulate may be more ductile and pliable than the first encapsulate, and may comprise an elastomeric material. The second encapsulate may thus be better for absorbing the expansion and contraction of the core assembly 30 and shield the outer core 34 from the rest of the encapsulate material to prevent propagation of cracks.

Figure 4:
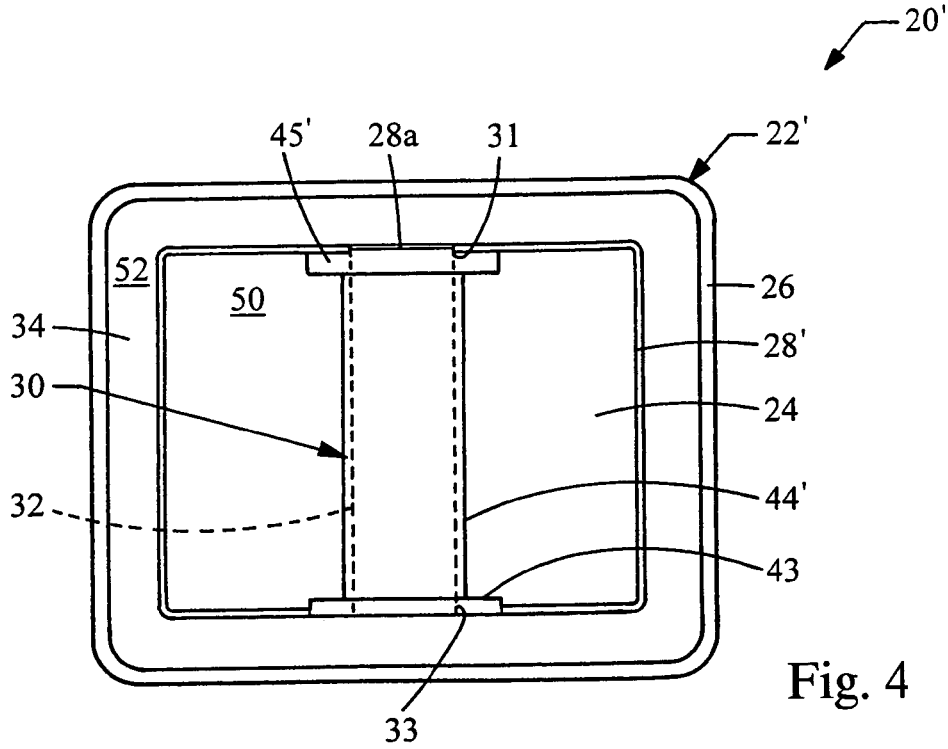
FIG. 4 is a top view showing another embodiment of the ignition coil constructed in accordance with the teachings of the present invention.

Turning to FIG. 4, an alternative embodiment of the coil assembly 20' has been depicted. In this embodiment, the inner wall 28 extends completely around in the inner periphery of the outer core 34. In this way, it will be recognized that the inner wall 28 provides the air gap between the inner core 32 and the outer core 34, which was denoted by reference numeral 36 in the prior embodiment. In this case, the primary bobbin 44' is substantially the same but is slightly reduced in size to accommodate the additional inner wall 28'. It will also be noted that the inner wall 28' includes a reduced thickness portion 28*a* which is used to form the air gap. That is, the reduced thickness portion 28*a* is sized and positioned at the first end 31 of the inner core 32 which abuts against the same. It will also be recognized that the inner wall could still provide the aperture 29 (shown in the prior embodiment) at the second end 33 of the inner core 32. In this way, only the single air gap located proximate the first end 31 of the inner core 32 (and adjacent reduced thickness portion 28*a*). Likewise, the inner wall 28' may also include a reduced thickness portion adjacent the second end 33 of the inner core 32 when it is desired to employ two air gaps.

Accordingly, it will be recognized by those skilled in the art that the present invention provides an ignition coil which includes a housing having an inner wall extending along the inner periphery of the outer core and positioned between the outer core and the coil assembly to prevent propagation of cracks in the encapsulate material. The inner wall may be sized and positioned to separate the outer core from direct contact with encapsulate in the vicinity of the coil assembly. The inner wall defines an inner compartment which may be filled with the encapsulate, while an outer compartment between the inner and outer walls may be filled with the same encapsulate or a substance different than the encapsulate, including air.

Finally, the inner wall also adds a layer of dielectric material between the core assembly and the high voltage formed in the secondary winding. The inner wall also separates the steel lamination stacks of the outer core from the copper windings and the plastic bobbins. In this way, the present invention protects against dielectric breakdown from the high voltage of the secondary winding to the steel lamination stacks.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. An ignition coil for an internal combustion engine comprising;

a housing having a bohom wall connected to an outer wall extending around the periphery of the housing;

an outer core positioned inside the outer wall of the housing;

an inner core positioned inside the outer core;

a coil assembly mounted to the inner core, the coil assembly including a primary winding and a secondary winding concentrically positioned relative to each other, the coil assembly positioned inside the outer core; and the housing further having an inner wall extending along the inner periphery of the outer core and positioned between the outer core and the coil assembly, and the inner wall being integrally formed with the housing and constructed of a plastic material.

2. The ignition coil of claim 1, further comprising an encapsulate filling at least a portion of the housing and covering the coil assembly, the inner wall separating the outer core from direct contact with encapsulate in the vicinity of the coil assembly.

3. The ignition coil of claim 2, wherein the inner wall defines an inner compartment, and wherein the inner and outer walls define an outer compartment therebetween, the inner compartment being filled with encapsulate.

4. The ignition coil of claim 3, wherein the outer compartment is filled with a substance different than the encapsulate.

5. The ignition coil of claim 4, wherein the outer compartment is filled with air.

6. The ignition coil of claim 4, wherein the outer compartment is filled with a substance having more ductility than the encapsulate.

7. The ignition coil of claim 1, wherein the inner wall extends between the inner core and the outer core to form an air gap therebetween.

8. The ignition coil of claim 7, wherein the inner core includes first and second ends, each end positioned proximate the outer core, and wherein the inner wall extends between the first end of the inner core and the outer core to form the air gap.

9. The ignition coil of claim 8, wherein the inner wall also extends between the second end of the inner core and the outer core.

10. The ignition coil of claim 1, wherein a first end of the inner core includes a permanent magnet attached thereto and engaging an inner surface of the outer core, the first end and magnet extending through an aperture formed in the inner wall.

11. The ignition coil of claim 8, wherein the inner wall includes a reduced thickness portion positioned adjacent the first end of the inner core, the reduced thickness portion forming the air gap.

12. The ignition coil of claim 8, wherein the inner wall includes a permanent magnet integrally formed therein, the permanent magnet positioned adjacent the first end of the inner core.

13. The ignition coil of claim 1, wherein the inner wall extends upwardly to a position at or above an upper surface of the outer core.

14. The ignition coil of claim 1, wherein the inner wall extends upwardly to a position at or above an upper surface of the coil assembly.

15. The ignition coil of claim 1, wherein the inner wall extends upwardly to a position aligned with an upper end of the outer wall.

16. An ignition coil for an internal combustion engine comprising:

a housing having a bottom wall connected to an outer wall extending around the periphery of the housing;

an outer core positioned inside the outer wall of the housing;

an inner core positioned inside the outer core and including first and second ends, each of the first and second ends positioned proximate the outer core;

a coil assembly mounted to the inner core, the coil assembly including a primary winding and a secondary winding concentrically positioned relative to each other, the coil assembly positioned inside the outer core; and the housing further having an inner wall extending along the inner periphery of the outer core and positioned between the outer core and the coil assembly, wherein the inner wall extends between the first end of the inner core and the outer core to form a first air gap, and the inner wall also extends between the second end of the inner core and the outer core.

* * * * *